US008267876B2

(12) United States Patent
Ashihara et al.

(10) Patent No.: US 8,267,876 B2
(45) Date of Patent: Sep. 18, 2012

(54) WALKING ASSIST DEVICE

(75) Inventors: Jun Ashihara, Wako (JP); Yasushi Ikeuchi, Wako (JP); Hiroshi Kudoh, Wako (JP); Yutaka Hiki, Wako (JP); Tatsuya Noda, Wako (JP); Takeshi Koshiishi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 378 days.

(21) Appl. No.: 12/671,599

(22) PCT Filed: Apr. 15, 2008

(86) PCT No.: PCT/JP2008/057358

§ 371 (c)(1),
(2), (4) Date: Feb. 1, 2010

(87) PCT Pub. No.: WO2009/019910

PCT Pub. Date: Feb. 12, 2009

(65) Prior Publication Data

US 2010/0204621 A1 Aug. 12, 2010

(51) Int. Cl.
*A61H 1/00* (2006.01)

(52) U.S. Cl. ..... 601/34; 601/35

(58) Field of Classification Search ..... 601/5, 34, 601/35; 602/23, 28; 623/30, 40
See application file for complete search history.

(56) References Cited

U.S. PATENT DOCUMENTS

| | | | | |
|---|---|---|---|---|
| 4,872,665 | A * | 10/1989 | Chareire | 482/51 |
| 7,137,959 | B2 * | 11/2006 | Phillips | 601/5 |
| 7,153,242 | B2 * | 12/2006 | Goffer | 482/66 |
| 2004/0102723 | A1 * | 5/2004 | Horst | 601/5 |
| 2004/0158175 | A1 * | 8/2004 | Ikeuchi et al. | 601/5 |
| 2006/0004307 | A1 * | 1/2006 | Horst | 601/5 |
| 2006/0211956 | A1 * | 9/2006 | Sankai | 601/5 |
| 2006/0270951 | A1 * | 11/2006 | Ikeuchi | 601/5 |
| 2008/0161937 | A1 * | 7/2008 | Sankai | 623/25 |

FOREIGN PATENT DOCUMENTS

| | | |
|---|---|---|
| JP | 2006-116630 | 5/2006 |
| JP | 2007-020909 | 2/2007 |
| JP | 2007-325732 | 12/2007 |

* cited by examiner

*Primary Examiner* — Nicholas Lucchesi
*Assistant Examiner* — Gerald Landry, II
(74) *Attorney, Agent, or Firm* — Rankin, Hill & Clark LLP

(57) ABSTRACT

A walking assist device having a load transmit portion, a leg link connected to the load transmit portion, and a driving source capable of driving the leg link in a direction to raise a seat member, so that at least a partial weight of a user may be supported by the leg link through the load transmit portion. An electric component to be used for controlling the driving source can be mounted on the walking assist device without degrading the compactness of the walking assist device. At least a part of the leg link is constituted of a cylindrical link member in which at least the electric component, such as a motor driver to be used for the control of the driving source, is partially housed. The walking assist device also includes a heat transfer member for absorbing the heat of the electric component by the cylindrical link member. The heat transfer member is thermally connected to a side plate of the cylindrical link member directed toward the side opposite to the leg of the user.

17 Claims, 5 Drawing Sheets

WALKING ASSIST DEVICE

PRIORITY CLAIM

The present application is based on and claims the priority benefit of Japanese Patent Application 2007-202996 filed on Aug. 3, 2007, the contents of which are incorporated herein by reference in its entirety.

BACKGROUND OF THE INVENTION

1. Field of the Invention

The present invention relates to a walking assist device which assists a user in walking by relieving a load applied to a leg thereof.

2. Description of the Related Art

Conventionally, there has been known a walking assist device having a seat member, a leg link connected to the load transmit portion and provided with at least one joint portion and a driving source for driving the joint portion provided in the leg link (for example, refer to Japanese Patent Laid-open No. 2007-20909). The driving source in this type of walking assist device drives the leg link in the direction of pushing up the seat member; therefore, at least a partial weight of a user is supported by the seat member through the leg link, and as a result thereof, the walking assist device can assist the user in walking by relieving a load applied to a leg thereof.

In this type of the walking assist device, the load transmit portion is configured as a seat member where the user sits astride, and the leg link is disposed inward the leg of the user in the lateral direction thereof. According thereto, the seat member and the leg link are positioned below the hip of the user, and consequently, a hand of the user will not hit the load transmit portion and the leg link while walking. Therefore, free hand swing in walking is enabled, making the walking assist device more convenient for use.

However, in the conventional walking assist device, electric components such as a controller for controlling the driving source, a motor driver and the like are housed in a backpack, and the backpack is shouldered by the user, which becomes a burden to the user. Thereby, it is expected to relieve the burden from the user by disposing the electric components in the walking assist device.

SUMMARY OF THE INVENTION

The present invention has been accomplished by improving conventional arts in view of the aforementioned problems, and it is therefore an object of the present invention to provide a walking assist device capable of relieving a burden from a user by disposing an electric component in the walking assist device.

To accomplish an object described above according to the present invention, a first aspect of the present invention provides a walking assist device which comprises a load transmit portion, a leg link connected to the load transmit portion and provided with at least one joint portion and a driving source for driving the joint portion provided in the leg link, and supports at least a partial weight of a user with the leg link through the load transmit portion by operating the driving source to drive the joint portion to make the leg link push up the load transmit portion, wherein the leg link is at least partially constituted of a cylindrical link member; the cylindrical link member is configured to house at least partially an electric component for controlling the driving source; and the cylindrical link member and the electric component housed in the cylindrical link member are thermally connected by a heat transfer member.

A second aspect of the present invention provides a walking assist device which comprises a load transmit portion composed of a seat member where a user sits astride, a leg link connected to the load transmit portion and provided with at least one joint portion and a driving source for driving the joint portion provided in the leg link, and supports at least a partial weight of the user with the leg link through the load transmit portion by operating the driving source to drive the joint portion to make the leg link push up the load transmit portion, wherein the seat member is configured to house at least partially an electric component for controlling the driving source; a heat transfer member is disposed at a surface of the seat member opposite to the other surface thereof contacted by the user; and the heat transfer member is thermally connected to the electric component disposed in the seat member.

Since the walking assist device is compactly designed, it is not easy to provide a space to dispose the electric component. However, according to the first aspect of the present invention, by making good use of the long link member constituting the leg link as a disposing space for the electric component, the electric component can be reasonably disposed in the walking assist device without degrading the compactness thereof. Consequently, the burden to the user can be relieved.

According to the first aspect of the present invention, the link member housing the electric component is formed into a cylindrical shape and the electric component is disposed inside the cylindrical link member, the protection of the electric component against mechanical damage, dust and water can be achieved without the need of providing extra covering members. Moreover, even the built-in electric component generates heat when electrified, since the cylindrical link member is long and has a relatively greater heat capacity, the heat generated by the electric component can be transferred to the cylindrical link member through the heat transfer member and absorbed by the cylindrical link member. Accordingly, there is no need to provide a special cooling device for the electric component, which contributes to the compactness of the walking assist device.

Further, if the cylindrical link member is made of dielectric material, the built-in electric component can be protected against external electromagnetic waves, and as a result thereof, malfunctions due to incoming noises can be prevented.

Furthermore, in the first aspect of the present invention, the load transmit portion is composed of a seat member where the user sits astride, the leg link is positioned inward a leg of the user in a lateral direction of the leg, and it is desirable to thermally connect the heat transfer member to a side plate disposed inward the cylindrical link member in a lateral direction of the cylindrical link member. According thereto, the temperature of the side plate at the outer side of the cylindrical link member, facing the leg of the user in the lateral direction, will not become too high even though the heat generated by the electric component is absorbed by the cylindrical link member. Thus, the user will not feel uncomfortable by the heat applied to the leg thereof.

According to the second aspect of the present invention, by making good use of the seat member as a disposing space for the electric component, the electric component can be reasonably disposed in the walking assist device without degrading the compactness thereof. Consequently, the burden to the user can be relieved. Further, even though the electric component generates heat when electrified, the heat generated by the electric member can be released through the cylindrical link member. Accordingly, there is no need to provide a special cooling device for the electric component, which contributes to the compactness of the walking assist device. Furthermore, since the heat transfer member is disposed at a surface of the seat member opposite to the other surface thereof contacted by the user, the user can be prevented from being subjected to the heat released from the heat transfer member.

DETAILED DESCRIPTION OF THE PREFERRED EMBODIMENTS

A walking assist device according to an embodiment of the present invention will be described hereinafter.

Figure 1:
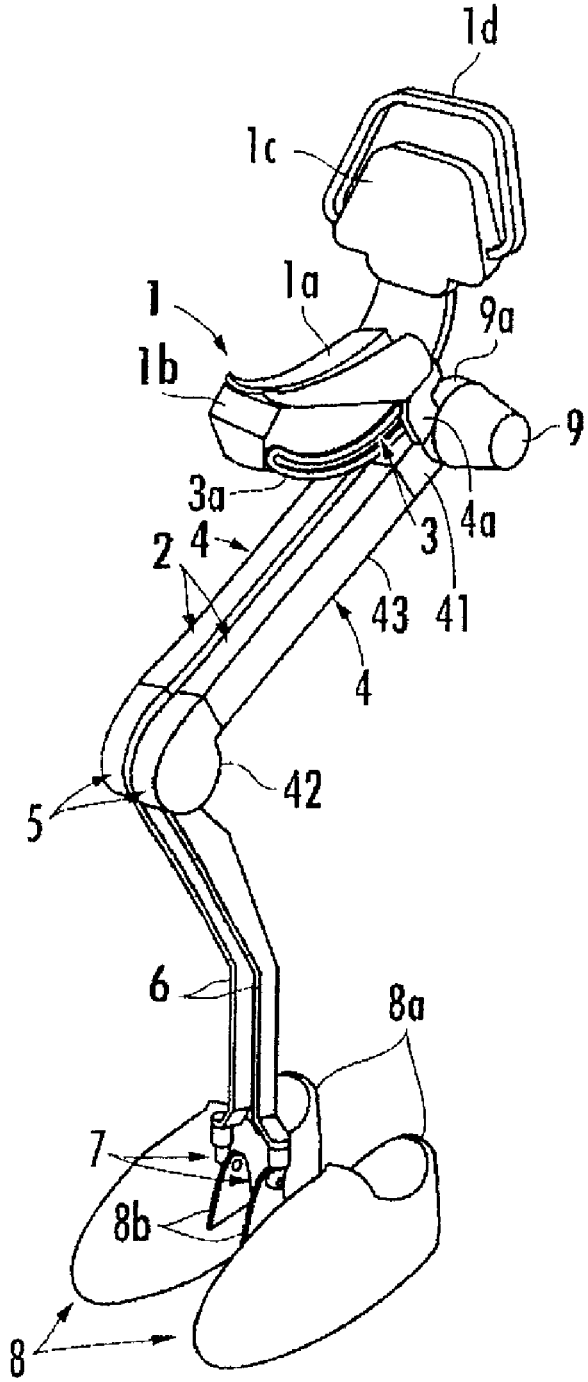
FIG. 1 is a perspective view illustrating a walking assist device according to an embodiment of the present invention.
Figure 2:
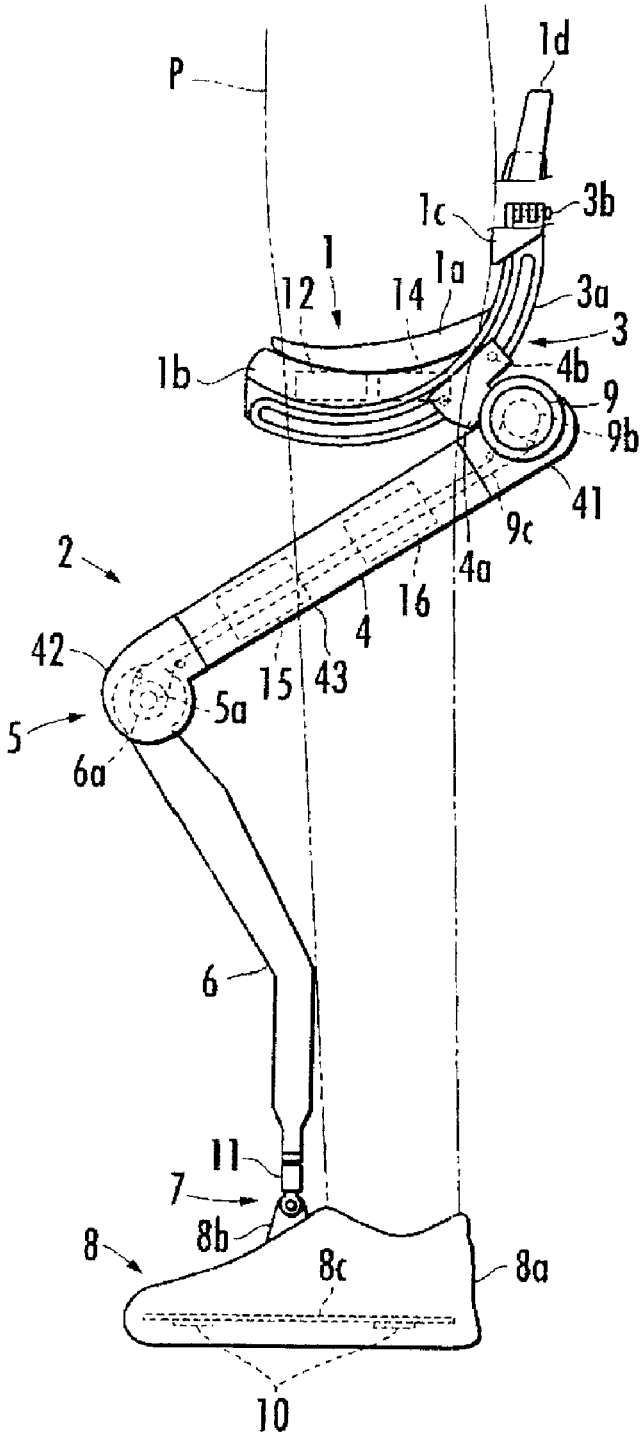
FIG. 2 is a side view illustrating the walking assist device according to an embodiment of the present invention.
Figure 3:
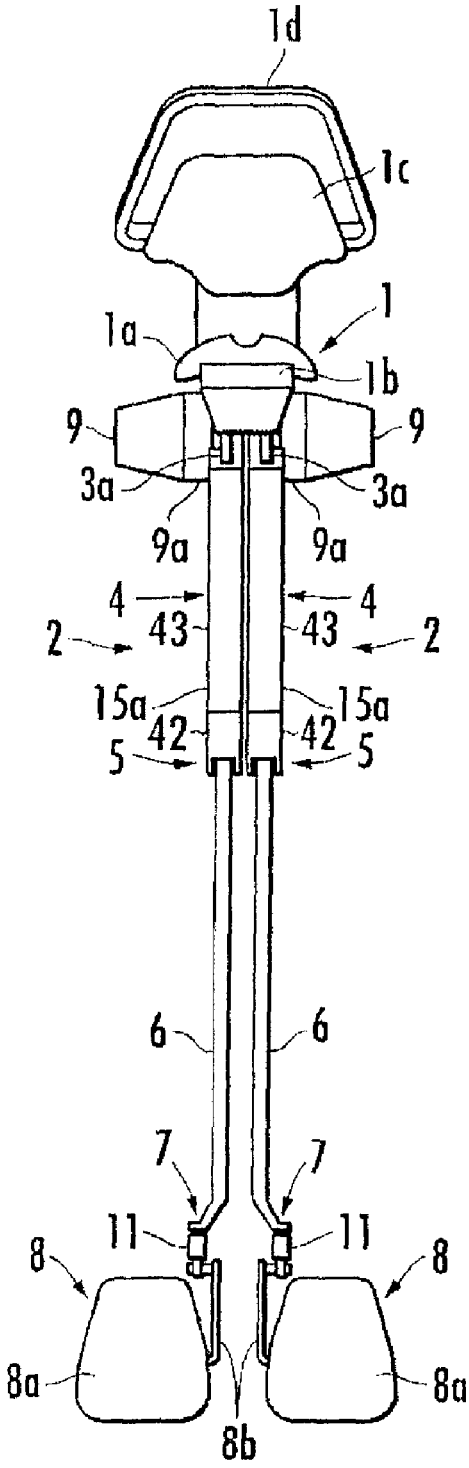
FIG. 3 is a front view illustrating the walking assist device according to an embodiment of the present invention.

As illustrated in FIG. 1 through FIG. 3, the walking assist device is provided with a seat member 1 which is equivalent to a load transmit portion where a user P sits astride, a pair of left and right leg links 2 and 2 connected to the seat member 1.

Each leg link 2 is a freely stretchable and bendable link composed of a first link 4 connected to the seat member 1 through a first joint portion 3 at the upper end portion of the first link 4 and a second link 6 connected to the lower end portion of the first link 4 through a rotary second joint portion 5. The lower end portion of the second link 6 is connected through a third joint portion 7 to a foot installation portion 8 to be mounted by each foot of the user P.

Each leg link 2 is further mounted with a driving source 9 for driving the second joint portion 5. When the second joint portion 5 is driven by the driving source 9 to rotate, each leg link 2 is operated to move in the stretching direction, namely, in the direction of pushing the seat member 1 upward, to generate a support force supporting a partial body weight of the user (hereinafter referred to as body weight relieving assist force). The body weight relieving assist force generated by each leg link 2 is transmitted to the body trunk of the user P through the seat member 1 to relieve the load applied to the feet of the user P.

The seat member 1 is composed of a seat portion 1*a* where the user P sits, a support frame 1*b*, and a waist supporter 1*c*. The seat portion 1*a* is of a saddle shape. The support frame 1*b* is disposed below the seat portion 1*a* to support the seat portion 1*a*. The support frame 1*b* is configured to extend upward behind the seat portion 1*a*. The support frame 1*b* has an uprising portion at a rear end thereof. The waist supporter 1*c* is fixed at the uprising portion. The waist supporter 1*c* is provided with a holding portion 1*d* of an arch shape to be held by the user P if necessary.

When the user P sits on the seat member 1, each leg link 2 is positioned inward each leg of the user P in the lateral direction. Therefore, when the walking assist device is in use, the seat member 1 and the leg links 2 are positioned below the hip of the user P. Consequently, the hands of the user will not hit the seat member 1 or the leg links 2 while walking. Thereby, free hand swing in walking is enabled, making the walking assist device more convenient for use.

The first joint portion 3 at the upper end portion of each leg link 2 has a guide rail 3*a* of an arc shape disposed below the seat member 1. Each leg link 2 is movably engaged with the guide rail 3*a* via a plurality of rollers 4*b* pivotally attached to a slider 4*a* which is fixed at the upper end portion of the first link 4. In this way, each leg link 2 swings in the anteroposterior direction around the center of curvature of the guide rail 3*a*. The anteroposterior swing fulcrum of each leg link 2 functions as the center of curvature of the guide rail 3*a*.

Furthermore, the guide rail 3*a* is pivotally supported at the uprising portion formed at the rear end of the support frame 1*b* of the seat member 1 via a spindle 3*b* disposed in the anteroposterior direction. Therefore, the guide rail 3*a* is connected to the seat member 1, capable of swinging freely in the lateral direction. Accordingly, each leg link 2 is allowed to swing in the lateral direction, which enables the user P to abduct the legs thereof. In addition, the center of curvature of the guide rail 3*a* and the axis line of the spindle 3*b* are both located above the seat portion 1*a*. Thereby, the seat member 1 can be prevented from inclining greatly both in the vertical direction and the lateral direction when the user P shifts the body weight thereof.

The driving source 9 is an electric motor provided with a reduction gear 9*a* which is attached to a lateral surface of the upper end portion of the first link 4 of each leg link 2. As illustrated in FIG. 2, an output member of the reduction gear 9*a*, that is, a driving pulley 9*b* and a driven pulley 6*a* which is fixed concentrically with a joint axis 5*a* of the second joint portion 5 at the second link 6 are connected through a wrapping transmission member 9*c*, such as a wire, a chain, a belt or the like. Thereby, the driving force output from the driving source 9 through the reducing gear 9*a* is transmitted through the wrapping transmission member 9*c* to the second link 6 so that the second link 6 swings around the joint axis 5*a* with respect to the first link 4 to stretch or bend the leg link 2.

Each foot installation portion 8 is composed of a shoe 8*a* and a connection member 8*b* which is fixed at the shoe 8*a* and extends upward. The second link 6 of each leg link 2 is connected to the connection member 8*b* through the third joint portion 7 of a 3-axis structure. As illustrated in FIG. 2, a pair of longitudinally disposed pressure sensors 10 and 10, which detect loads applied to the metatarsophalangeal joint (MP joint) and the heel of each foot of the user P, respectively, are attached to the undersurface of an insole 8*c* provided in the shoe 8*a*. Moreover, a 2-axis force sensor 11 is built into the third joint portion 7.

The walking assist device is provided with a battery 12, a power source plate 13, a controller 14, a sensor amplifier 15 and a motor driver 16 as electric components to be used for controlling the driving source 9. Detection signals from the pressure sensors 10 and the force sensor 11 are input into the controller 14 after amplified by the sensor amplifier 15. On the basis of the detection signals from the pressure sensors 10 and the force sensor 11, the controller 14 performs a walking assist control by controlling the driving source 9 through the motor driver 16 to drive the second joint portion 5 of the leg link 2 to generate the body weight relieving assist force.

The body weight relieving assist force is applied on a connection line (hereinafter, referred to as a reference line) joining a swing fulcrum of the leg link 2 with respect to the first joint portion 3 in the anteroposterior direction and a swing fulcrum of the leg link 2 with respect to the third joint portion in the anteroposterior direction. In the walking assist control, the actual body weight relieving assist force applied on the reference line (accurately, a resultant force between the body weight relieving assist force and a force generated by the weights of the seat member 1 and each leg link 2) is calculated based on detection values of forces in the two-axis direction detected by the force sensor 11. Thereafter, on the basis of the stepping force detected by the pressure sensors 10 in each foot installation portion 8, a ratio of the stepping force of each leg with respect to the resultant force from both legs of the user P is calculated. Then, a desired control value of the body weight relieving assist force which should be generated in each leg link 2 is calculated by multiplying a predefined value of the body weight relieving assist force by the calculated ratio of the stepping force of each leg. Subsequently, the driving source 9 is controlled so as to make the actual body weight relieving assist force calculated on the basis of the detection values by the force sensor 11 approximate to the desired control value.

Figure 4:
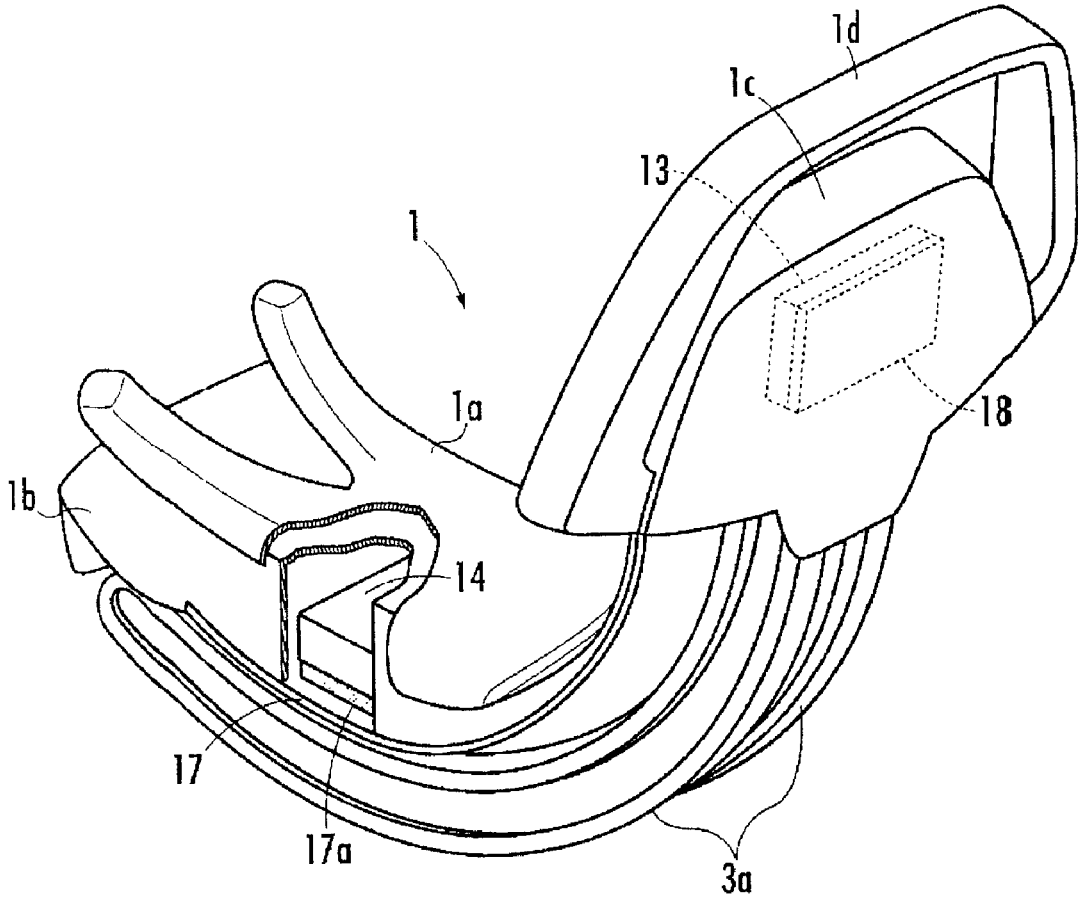
FIG. 4 is a perspective view illustrating a seat member of the walking assist device according to an embodiment of the present invention.

There has been considered that the electric components for controlling the driving source 9 are packed in the backpack to be shouldered by the user, however, this would becomes a burden to the user. According to the present embodiment, the battery 12 and the controller 14 are housed in the seat frame 1*b* of the seat member 1, and the power source plate 13 is built into the waist supporter 1*c* as illustrated in FIG. 4. The back surface of the seat frame 1*b*, in other words, the surface opposite to the other surface where the user of the seat member 1 contacts, is provided with a heat transfer member 17. The heat transfer member 17 is made of a metallic plate with high thermal conductivity, such as aluminum and the like. The heat transfer member 17 is connected to the battery 12 and the controller 14 through a contact layer 17*a* with good thermal conductivity, such as silicon and the like. Accordingly, the heat transfer member 17 is connected thermally to the battery 12 and the controller 14. Moreover, an inner portion of the waist supporter 1*d* toward the back side is thermally connected to the power source plate 13 through a heat transfer member 18 made of a metallic plate with high thermal conductivity, such as aluminum and the like.

According to the above-mentioned configuration, by making good use of the seat member 1 as a disposing space for the electric components, the electric components can be reasonably disposed in the walking assist device without degrading the compactness thereof. Even the electric components including the battery 12, the controller 14 and the power source plate 13 generate heat, since the heat transfer members 17 and 18 are provided, the heat generated is released through the heat transfer members 17 and 18. Accordingly, there is no need to provide a special cooling device for the electric components, which contributes to the compactness of the walking assist device. Moreover, since the heat transfer members 17 and 18 are disposed at the surface of the seat member 1 opposite to the other surface thereof contacted by the user P, the user P can be prevented from being subjected to the heat released from the heat transfer members 17 and 18.

As mentioned above, the sensor amplifier 15 and the motor driver 16 are needed to control the driving source 9 in addition to the controller 14. However, it is spatially difficult to dispose the controller 14, the sensor amplifier 15 and the motor driver 16 inside the seat member 1. In this regard, the present embodiment makes good use of the long component, that is, the first link 4 of the leg link 2 as the disposing space for the sensor amplifier 15 and the motor driver 16. As to be described hereinafter, the sensor amplifier 15 and the motor driver 16 can be reasonably disposed in the walking assist device without degrading the compactness thereof.

Figure 5:
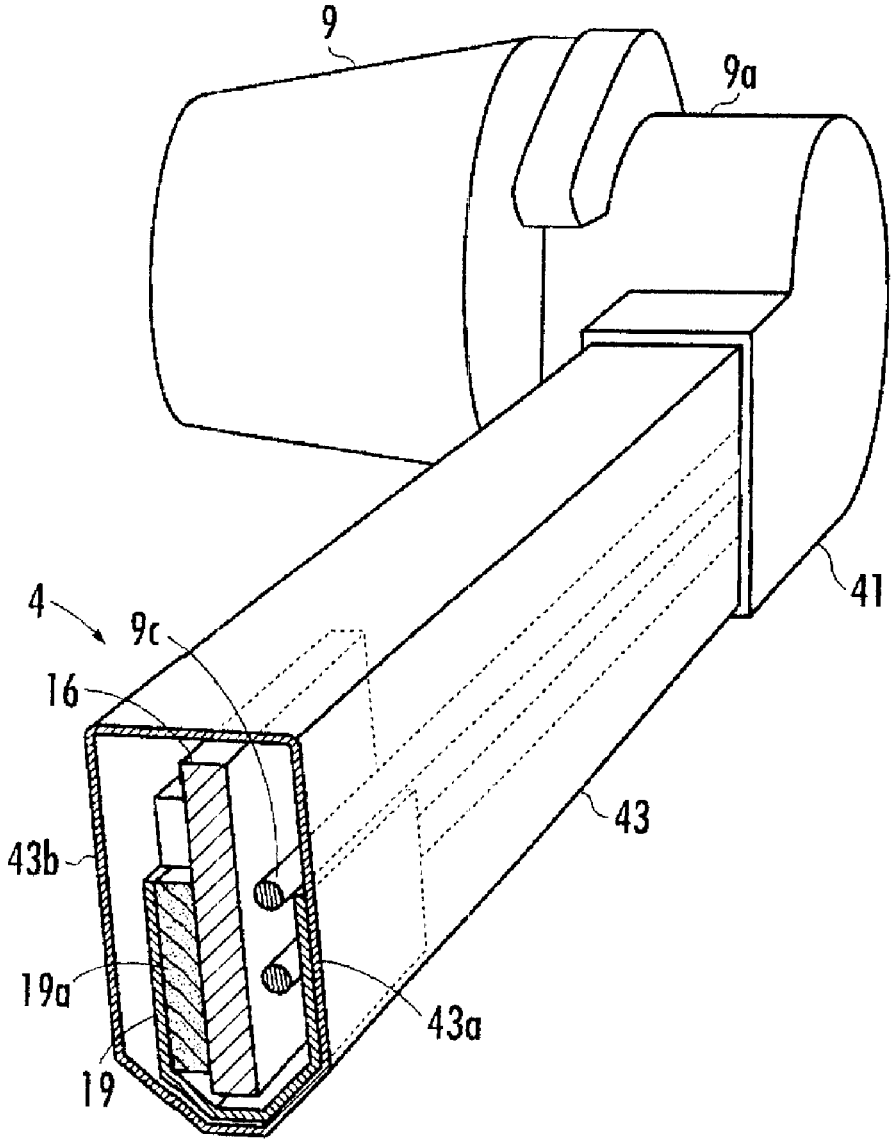
FIG. 5 is a perspective view illustrating partially a leg link of the walking assist device according to an embodiment of the present invention.

The first link 4 includes an upper first case portion 41 where the driving source 9 is disposed, a lower second case portion 42 covering the second joint portion 5, and a cylindrical link member 43 joining the first case portion 41 and the second case portion 42 as illustrated in FIG. 5. The cylindrical link member 43 is made of dielectric material such as a metal. The sensor amplifier 15 and the motor driver 16 are housed inside the cylindrical link member 43 (only the motor driver 16 is illustrated in FIG. 5).

Moreover, a heat transfer member 19 is disposed inside the cylindrical link member 43. The cylindrical link member 43 and the built-in electric components composed of the sensor amplifier 15 and the motor driver 16 are thermally connected through the heat transfer member 19. The heat transfer member 19 is made of a metallic plate with high thermal conductivity, such as aluminum and the like. The heat transfer member 19 is formed into a U-shape in profile to avoid interfering with the wrapping transmission member 9*c* inserted through the cylindrical link member 43. One side plate of the heat transfer member 19 in the lateral direction is joined to the built-in electric components 15 and 16 through a contact layer 19*a* with good heat conductivity, such as silicon and the like, the other side plate of the heat transfer member 19 is joined through screwing or welding to the inner surface of a side plate 43*a* at the inner side of the cylindrical link member 43 in the lateral direction, opposite to the surface contacted by the legs of the user P.

According to the above-mentioned configuration, since the electric components 15 and 16 are housed in the cylindrical link member 43 of the leg link 2, the protection of the electric components 15 and 16 against mechanical damage, dust and water can be achieved without the need of providing extra covering members. Further, the cylindrical link member 43 is made of dielectric material, the built-in electric components 15 and 16 can be protected against external electromagnetic waves, and as a result thereof, malfunctions due to incoming noises can be prevented.

Moreover, even the built-in electric components 15 and 16 generate heat when electrified, since the cylindrical link member 43 is long and has a relatively greater heat capacity, the heat generated by the built-in electric components 15 and 16 can be transferred to the cylindrical link member 43 through the heat transfer member 19 and absorbed by the cylindrical link member 43. Accordingly, there is no need to provide special cooling devices for the built-in electric components 15 and 16, which contributes to the compactness of the walking assist device.

Since the heat transfer member 19 is thermally connected to the side plate 43*a* at the inner side of the cylindrical link member 43 in the lateral direction, the side plate 43*b* at the outer side of the cylindrical link member 43, facing the legs of the user P, will not effected by the heat released from the side plate 43*a*, and thus, the temperature thereof will not become too high. Therefore, the user P will not feel uncomfortable by the heat applied to the legs thereof.

Although the embodiment of the present invention has been described in the above with reference to the drawings, the present invention is not limited thereto. For example, in the embodiment mentioned above, the heat transfer members 17, 18 and 19 have been described to be made of metallic plates; however, it is acceptable for them to be made of heat pipes. In the embodiment mentioned above, the sensor amplifier 15 and the motor driver 16 have been described to be housed in the cylindrical link member 43 which constitutes the first link 4 of the leg link 2; however, it is acceptable to constitute at least a part of the second link 6 with a cylindrical link member and house the sensor amplifier therein. In the embodiment mentioned above, each leg link 2 has been described to be a freely stretchable and bendable link with the rotary second joint portion 5 disposed therein; however, it is acceptable that the leg link 2 is configured as a freely stretchable and bendable link with a linear second joint portion. In the embodiment mentioned above, the first joint portion 3 is configured to have the arc-shaped guide rail 3*a* and the anteroposterior swing fulcrum of each leg link 2 with respect to the first joint portion 3 is located above the seat portion 1*a* of the seat member 1; however, it is not limited thereto. For example, the first joint portion 3 may be configured as a simple-structured joint portion having a spindle to pivotally support each leg link 2 so that the upper end portion thereof can freely swing in the anteroposterior direction.

In the embodiment mentioned above, the seat member 1 is configured as the load transmit portion; however, it is acceptable to adopt a belt mounted around the waist of the user as the load transmit portion. Moreover, in order to assist the walking of a handicapped user whose one leg is crippled due to bone fracture or the like, it is possible to leave only one leg link of the left and right leg links 2 and 2 in the above-mentioned embodiment corresponding to the crippled leg of the user by removing the other.

What is claimed is:

1. A walking assist device comprising a load transmit portion, a leg link connected to the load transmit portion and provided with at least one joint portion, a driving source provided in the leg link for driving the joint portion, and an electric component configured to control the driving source, said walking assist device configured to support at least a partial weight of a user with the leg link through the load transmit portion by operating the driving source to drive the joint portion to make the leg link push up the load transmit portion, wherein the leg link is at least partially constituted of a hollow link member having an internal space;

the electric component includes at least one of a battery, a power source plate, a controller, a signal amplifier, and a motor driver, and at least one of the battery, the power source plate, the controller, the signal amplifier, and the motor driver is housed in the hollow link member, and a whole part of the electric component is housed in the hollow link member and exposed in the internal space of the hollow link member; and a heat transfer member thermally connects the hollow link member and the at least one of the battery, the power source plate, the controller, the signal amplifier, and the motor driver housed in the hollow link member.

2. The walking assist device according to claim 1, wherein the hollow link member is made of dielectric material.

3. The walking assist device according to claim 1, wherein the load transmit portion is composed of a seat member adapted for the user to sit astride, the leg link is connected to the load transmit portion so as to be disposed inward of a leg of the user in a lateral direction of the leg when the user sits astride the seat member, such that a laterally outwardly disposed side plate of the hollow link member faces the leg of the user, and the heat transfer member contacts and is thermally connected to a laterally inwardly disposed side plate of the hollow link member, which is opposed to the laterally outwardly disposed side plate of the hollow link member.

4. A walking assist device, comprising a load transmit portion, a leg link connected to the load transmit portion and provided with at least one joint portion, a driving source provided in the leg link for driving the joint portion, and an electric component configured to control the driving source, said load transmit portion including a seat member adapted for a user to sit astride, said walking assist device configured to support at least a partial weight of the user with the leg link through the load transmit portion by operating the driving source to drive the joint portion to make the leg link push up the load transmit portion, wherein the electric component includes at least one of a battery, a power source plate, a controller, a signal amplifier, and a motor driver, and at least one of the battery, the power source plate, the controller, the signal amplifier, and the motor driver is housed in the seat member;

a heat transfer member is disposed at a surface of the seat member opposite to a seat member surface contacted by the user; and the heat transfer member is thermally connected to the electric component disposed in the seat member.

5. The walking assist device according to claim 4, wherein the leg link is at least partially constituted of a hollow link member;

at least one of the battery, the power source plate, the controller, the signal amplifier, and the motor driver is housed in the hollow link member; and a leg link heat transfer member thermally connects the hollow link member and the at least one of the battery, the power source plate, the controller, the signal amplifier, and the motor driver housed in the hollow link member.

6. The walking assist device according to claim 5, wherein the leg link is connected to the load transmit portion so as to be disposed inward of a leg of the user in a lateral direction of the leg when the user sits astride the seat member, such that a laterally outwardly disposed side plate of the hollow link member faces the leg of the user, and the leg link heat transfer member contacts and is thermally connected to a laterally inwardly disposed side plate of the hollow link member, which is opposed to the laterally outwardly disposed side plate of the hollow link member.

7. The walking assist device according to claim 5, wherein the battery, the power source plate, and the controller are housed in the seat member; and the signal amplifier and the motor driver are housed in the hollow link member.

8. The walking assist device according to claim 1, wherein the signal amplifier and the motor driver are housed in the hollow link member.

9. The walking assist device according to claim 3, wherein the signal amplifier and the motor driver are housed in the hollow link member.

10. The walking assist device according to claim 3, wherein the battery, the power source plate, and the controller are housed in the seat member.

11. The walking assist device according to claim 1, wherein the heat transfer member is made of a metallic plate having a thermal conductivity greater than that of the hollow link member of the leg link.

12. The walking assist device according to claim 3, wherein the heat transfer member is made of a metallic plate having a thermal conductivity greater than that of the hollow link member of the leg link.

13. The walking assist device according to claim 4, wherein the heat transfer member is made of a metallic plate having a thermal conductivity greater than that of the seat member.

14. The walking assist device according to claim 5, wherein the heat transfer member is made of a metallic plate having a thermal conductivity greater than that of the seat member, and the leg link heat transfer member is made of a metallic plate having a thermal conductivity greater than that of the hollow link member of the leg link.

15. The walking assist device according to claim 6, wherein the heat transfer member is made of a metallic plate having a thermal conductivity greater than that of the seat member, and the leg link heat transfer member is made of a metallic plate having a thermal conductivity greater than that of the hollow link member of the leg link.

16. The walking assist device according to claim 1, wherein the at least one of the battery, the power source plate, the controller, the signal amplifier, and the motor driver housed in the hollow link member is entirely disposed within the hollow link member.

17. The walking assist device according to claim 4, wherein the at least one of the battery, the power source plate, the controller, the signal amplifier, and the motor driver housed in the seat member is disposed entirely within the seat member at a position where a crotch of the user when the user sits astride the seat member overlays the at least one of the battery, the power source plate, the controller, the signal amplifier, and the motor driver housed in the seat member.

* * * * *